US006198695B1

(12) United States Patent
Kirton et al.

(10) Patent No.: US 6,198,695 B1
(45) Date of Patent: Mar. 6, 2001

(54) EVENT MONITORING DEVICE

(76) Inventors: Raymond Eduardo Kirton, 44 High Ridge Rd., Redding, CT (US) 06896; Thomas Raymond Poulin, 169 Settlers Hill Rd., Southbury, CT (US) 06488

( * ) Notice: Subject to any disclaimer, the term of this patent is extended or adjusted under 35 U.S.C. 154(b) by 0 days.

(21) Appl. No.: 09/253,869

(22) Filed: Feb. 19, 1999

Related U.S. Application Data

(60) Provisional application No. 60/081,549, filed on Apr. 13, 1998, now abandoned.

(51) Int. Cl.[7] ..... G04B 47/00
(52) U.S. Cl. ..... 368/10
(58) Field of Search ..... 368/10, 89, 107–113

(56) References Cited

U.S. PATENT DOCUMENTS

| | | | |
|---|---|---|---|
| 4,293,845 | 10/1981 | Villa-Real | 340/309.3 |
| 4,490,711 | 12/1984 | Johnston | 340/309.4 |
| 4,504,153 | 3/1985 | Schollmeyer et al. | 368/10 |
| 4,725,997 | 2/1988 | Urquhart et al. | 368/10 |
| 4,754,423 | 6/1988 | Rollins | 364/900 |
| 4,858,207 | 8/1989 | Buchner | 368/10 |
| 4,971,221 | 11/1990 | Urquhart et al. | 221/2 |
| 5,097,429 | 3/1992 | Wood et al. | 364/569 |
| 5,157,640 | 10/1992 | Backner | 368/10 |
| 5,289,157 | 2/1994 | Rudick et al. | 340/309.15 |
| 5,337,290 | 8/1994 | Ventimiglia et al. | 368/10 |
| 5,612,869 | 3/1997 | Letzt et al. | 395/203 |
| 5,696,496 | 12/1997 | Kumar | 340/825.25 |
| 5,719,780 | 2/1998 | Holmes et al. | 364/479.01 |

*Primary Examiner*—Bernard Roskoski
(74) *Attorney, Agent, or Firm*—David S. Christensen

(57) ABSTRACT

This disclosure relates to a method of monitoring patent compliance using a multiple step event acknowledgment process.

a) programming a device with event times and descriptions,
b) comparing the event times to a system time,
c) alerting the patient when an event is to occur,
d) pausing the alert,
e) waiting a predetermined amount of time,
f) acknowledging said alerting after said alert was paused and before the end of said predetermined amount of time.

An apparatus for carrying out said method. The apparatus consisting of a portable device having a microcontroller with memory for storing said event times and descriptions. The device further including a prompting means for alerting the patient and event pause and acknowledgment functions. In an alternate embodiment, the portable device includes a microphone for allowing the patient to record verbal messages for later replay by a clinician.

27 Claims, 17 Drawing Sheets

EVENT MONITORING DEVICE

CROSS-REFERENCES TO RELATED APPLICATIONS

This application claims the benefit of U.S. Provisional application Ser. No. 60/081,549, filed Apr. 13, 1998, now abandoned.

BACKGROUND OF THE INVENTION

1. Field of Invention

This invention relates to a programmable medical event reminding and monitoring device. More particularly, to a device which can prompt an individual, and record said events for later analysis by a physician, care provider, or researcher.

2. Description of Related Art

One problem in the medical and pharmaceutical industry is determining whether a patient or participating subject, has properly taken prescribed medications at the proper times. In the medical industry, this is especially problematic with older patients who are taking multiple medications on a complex time schedule Traditionally, any attempt to record compliance with medications was done with paper, or via phone interviews. A form would be created by the doctor listing the medications along with times and instructions. The patient would then fill out the form as the medications were taken. Unfortunately, physicians have found this to be an unreliable method for tracking compliance. Typically, the patient will forget to mark the form and there is no way of assuring what time the medication was actually taken. Phone interviews have also been used, but are typically not accurate enough to constitute scientific data. A number of devices have been proposed to overcome the shortcomings of the traditional paper based system. They include:

U.S. Pat. No. 4,725,997 Urquhart et. al. relates to a programmable device that controls when the patient receives a dosage. The device is programmed with the schedule of pharmaceutical doses. At the prescribed time, the device alerts the patient and dispenses the medication. Alternatively, the patient may request the dosage and depending on some preset rules, the device may or may not dispense the medication. This invention also has means for recording these events and later reporting them to the physician.

U.S. Pat. No. 4,504,153 Schoilmeyer et. al. relates to a programmable prompting device that attaches to a medication container. At prescribed times, the device will produce a visible or audible signal to prompt the patient to take the medication. In one embodiment, the device also unlocks the container when the signal is generated thus preventing unscheduled dosages.

U.S. Pat. No. 4,971,221 Urquhart et. al. relates to a programmable device capable of dispensing medications at prescribed times and monitors the physical dispensing through the use of an optical sensor located in the dispensing port.

U.S. Pat. No. 4,490,711 Johnston relates to a programmable device for assisting a person in keeping track of events such as appointments or times to take medications. The user can program the device through a series of switches to set unique preset times. The user must also physically write on a piece of paper attached to the device what action corresponds with each timed event. This device is similar to the traditional paper based system with an alarm clock attached to the form.

SUMMARY OF INVENTION

Briefly described and in accordance with the embodiments thereof, it is considered an advantage to provide a medical event monitoring device which prompts and records the compliance of user medical events.

It is also considered advantageous of the present invention to provide a portable device, that may be carried by the user or test group participant. The device has a timer that keeps track of the time of day. It also has a means for receiving user profile data consisting of event descriptions, the scheduled time associated with those events, and means for storing it in electronic memory. A means for comparing the system time to the profile data is provided to determine if and when an event should take place. When an event takes place, a signaling means is activated to alert the user. Once the user has been notified, a set time interval is provided to allow acknowledgment of the prompt or notification, and a means for recording whether or not the patients acknowledgment of the event has occurred. Finally, the device has means for transmitting the recorded data to an external data collection apparatus.

Still another advantage is to provide a method for prompting the user to take action on a medical event and providing a means for determining if the user acknowledges the completion of the event First the device is programmed with a user profile that contains prescription data and the associated times. The data is periodically reviewed to determine if a medical event should be prompted. When the system time matches an event time, the user is prompted to take the medication. The user then has a predetermined amount of time to pause then a predetermined amount of time to acknowledge that the event has been completed. The device then records for each event whether or not the event occurred as scheduled.

It is still another advantage to provide a means for a physician, care provider, or researcher to retrieve the compliance data from the device.

It is considered a general advantage to provide a device that can overcome the shortcomings of the prior art discussed above.

Additional advantages and features of the invention will be set forth in the description that follows, and in part will become apparent to those skilled in the art on examination of the following, or may be learned by practice of the invention.

DETAILED DESCRIPTION OF THE INVENTION

Figure 1:
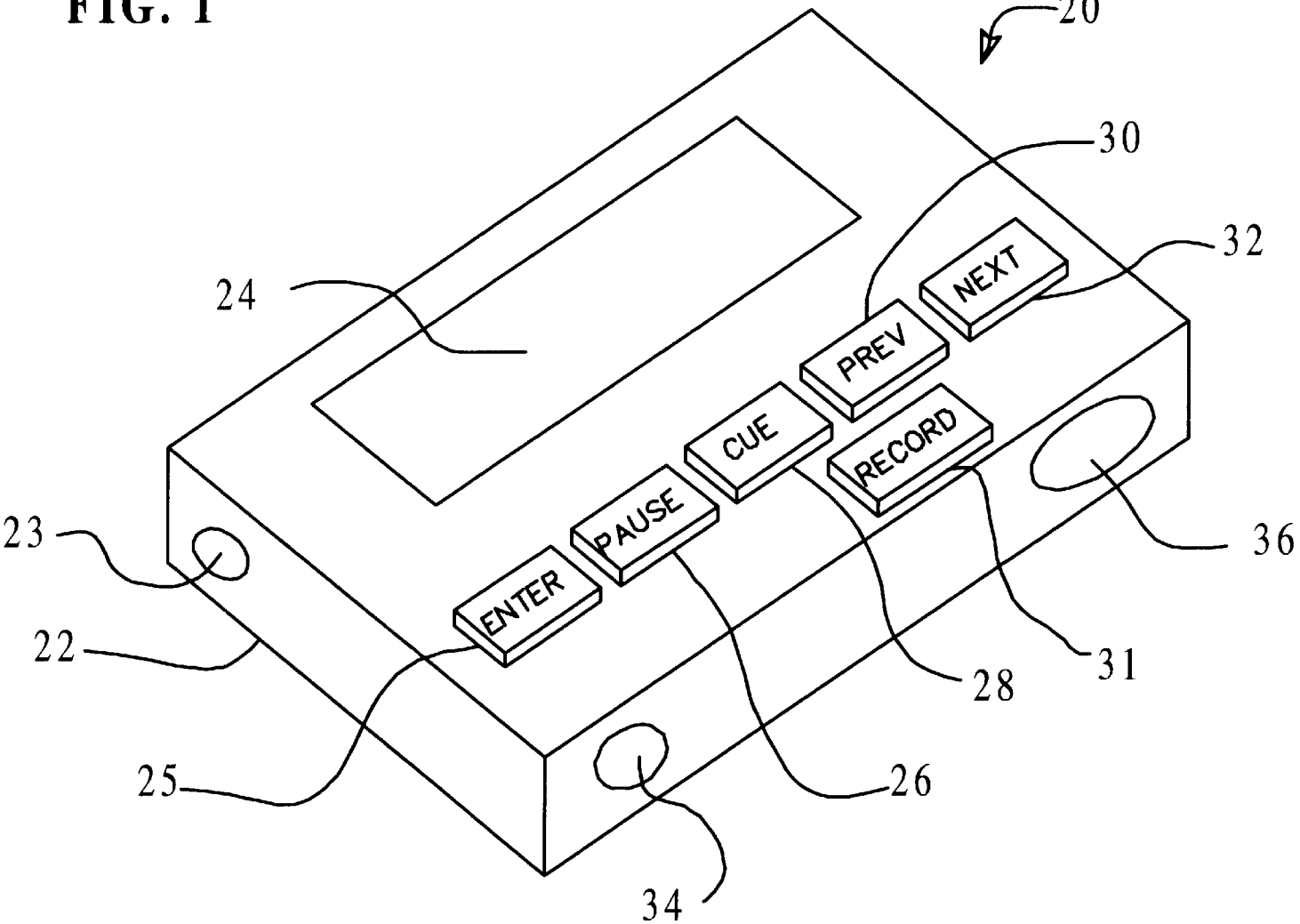
FIG. 1 is an perspective drawing of one embodiment of a portable event-monitoring device of this invention.

FIG. 1 illustrates one form of the portable medical event-monitoring device 20 in accord with this invention. Device 20 includes a case 22 made up of a message display 24, a microphone 34, speaker 36 and a set of controls 25, 26, 28, 30, 31, and 32. The use and operation of the controls 25, 26, 28, 30, 31, and 32 will be made dearer herein.

Figure 2:
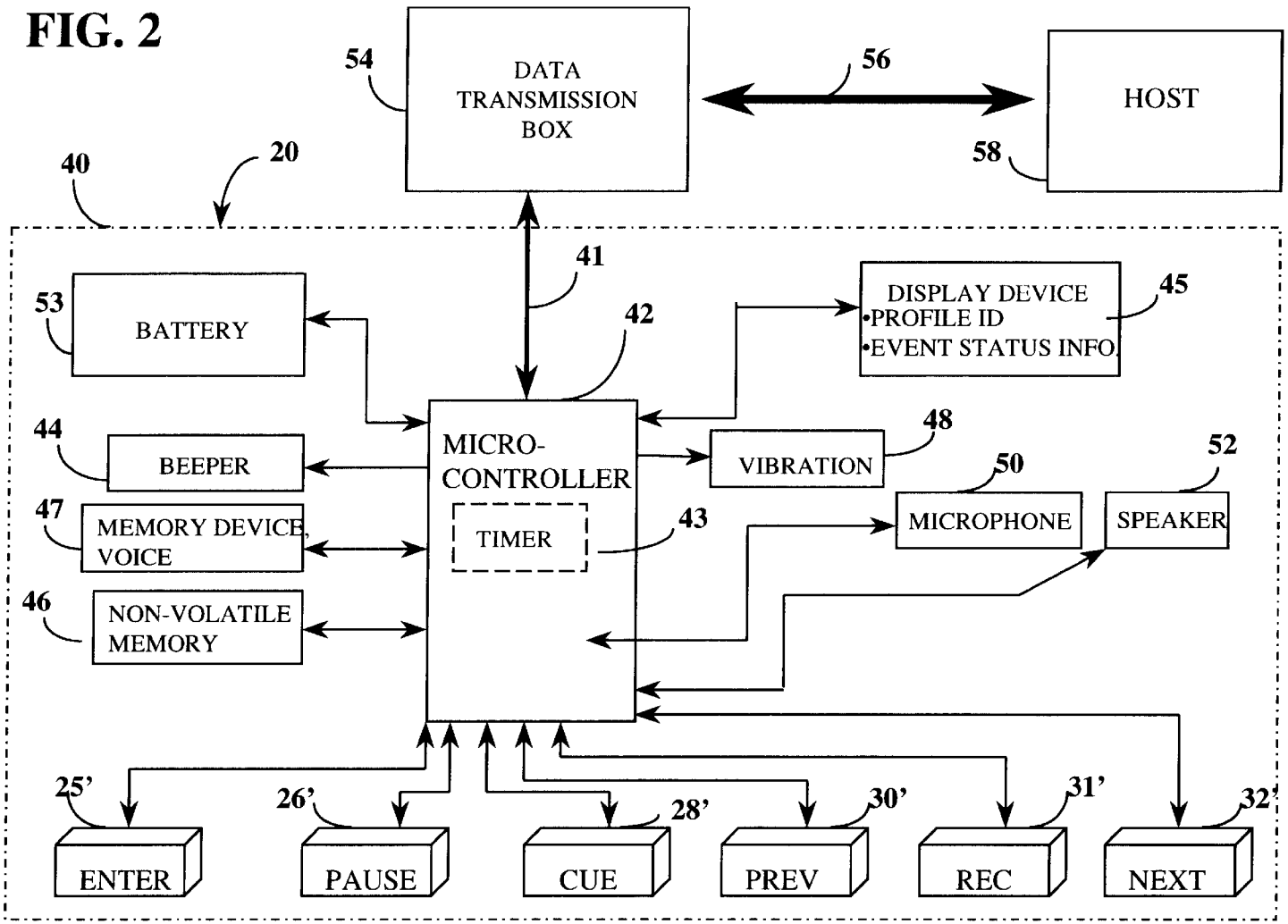
FIG. 2 is a block diagram showing the system of this invention.

FIG. 2 illustrates a systems block diagram for the device shown in FIG. 7. The device 20 is programmed and its date is transmitted via an external data transmission box 54 that in turn communicates through line 56 to a host computer 58. This communication line 56 can use one of a number of protocols such as; EIA RS485, EIA RS232, or IEEE 1073. Additionally, communication line 56 can represent any medium capable of carrying data, such as infrared, microwave, satellite or radio wave signals. When in the programming or set-up mode, the data box 54 relays information received from line 56 and transmits it to the device 20 via communications line 41 to a microcontroller 42 in the device 20. When the system is in data retrieval mode, the data box 54 receives stored historical information from the microcontroller via line 41 and transmits it to the host computer 58 via line 56. Typically, the host computer will be located with the party interested in programming or interrogating the device 20. While the data box 54 is shown in FIG. 1 to reside outside of the device 20, it is also possible to build this component internal to device 20. Traditionally, this host computer will reside in the doctor's office, pharmacy, or researcher's office.

The device 20 has a number of internal components. FIG. 2 shows these components in block form inside box 40. The microcontroller 42 or programmable microcontroller or equivalent, controls the operation of the device 20. MICROCHIP TECHNOLOGY 16F84 is an example of one type of microcontroller that may be used. When the microcontroller 42 receives the data via line 41, it stores the data in a memory device 46. Memory device 46 can be Dallas Semiconductor Inc. EEPROM, or any other suitable memory device. The microcontroller 42 has an internal timer device 43.

It should be noted that memory device 46 such as Dallas Semiconductor Inc. EEPROM are usually individually serialized. This individual serialization could be used by the host to automatically determine which device 20 is currently connected.

In operation, the timer 43 periodically polls the memory device 46 to determine if an event or occurrence is to take place. The timing of the polling can be any convenient time segment, such as every 5 to 10 seconds. If an event is required, the microcontroller 42 will activate one or more signal components. The device will display an informational message to the user via display device 45. This display device 45 can be a liquid crystal display (LCD) or any other suitable device. The information displayed on this device can be the description of a medication or any "special" information or instructions, that a doctor, pharmacist, researcher, or care-provider would want to include for the user. The individual components activated by microcontroller 42 can include a beeper 44 or vibration component 48. Beeper 44 can be a piezoelectric bender or other suitable device. The beeper 44 emits a high pitch audible tone alerting the user that an event needs to occur and to check the display 45. Alternatively, or in conjunction with the beeper 44, the microcontroller may activate vibration component 48. This vibration component 48 may be used in instances where the user desires a more private notification of an event.

In addition, depending on the programming instructions, the microcontroller may activate a prerecorded audible message via speaker 52 or initiate the recording of a message from microphone 50. Device 20 can play any message prerecorded by the physician or care provider. Contents might include, but are not limited to pharmaceutical name or acceptable abbreviation, dosage information, and "special" instructions.

In an alternate embodiment, the device is also capable of recording messages from the user which would provide a record back to the physician or care provider on any side effects that the user experienced during treated.

Figure 14:
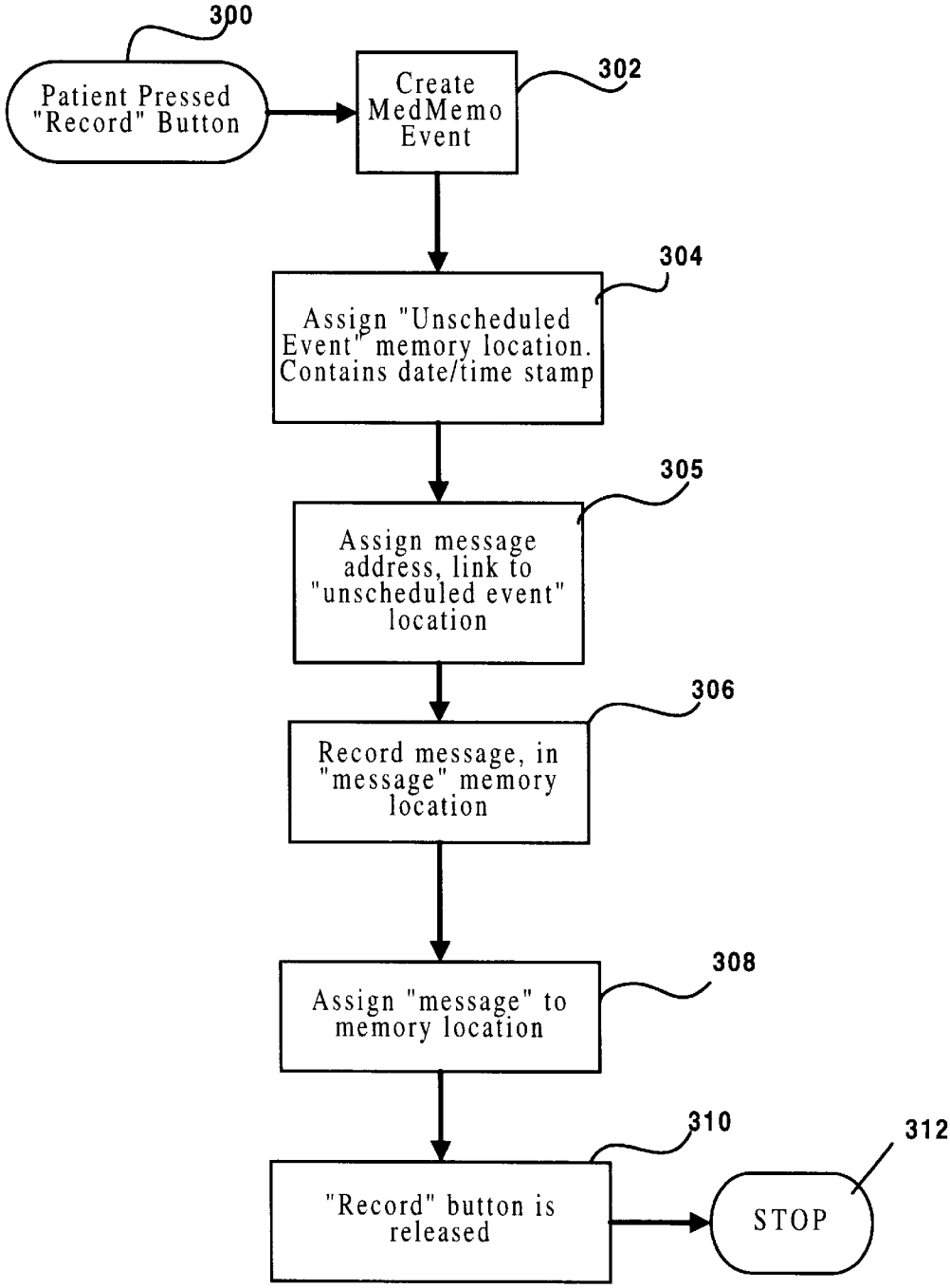
FIG. 14 is a flow chart of the method used for recording and storing messages.

As is seen in the flow chart in FIG. 14, when the user wants to record a message, the RECORD button 31' (FIG. 2) is depressed. In response to the RECORD button 31' being depressed (START box 300), the microcontroller 42 assigns 304 an Unscheduled Event memory location in memory device 46. This Event location 305 contains the data containing the date and time and the location of the memory address in memory device 47. After assigning the location 306, the message is recorded and stored in its assigned location 308 in memory device 47. Once the RECORD button 31' is released 310, the recording is stopped 312.

To prevent accidental activation of the recording function, the RECORD button 31' can be recessed slightly into the front of the device 20.

Figure 4:
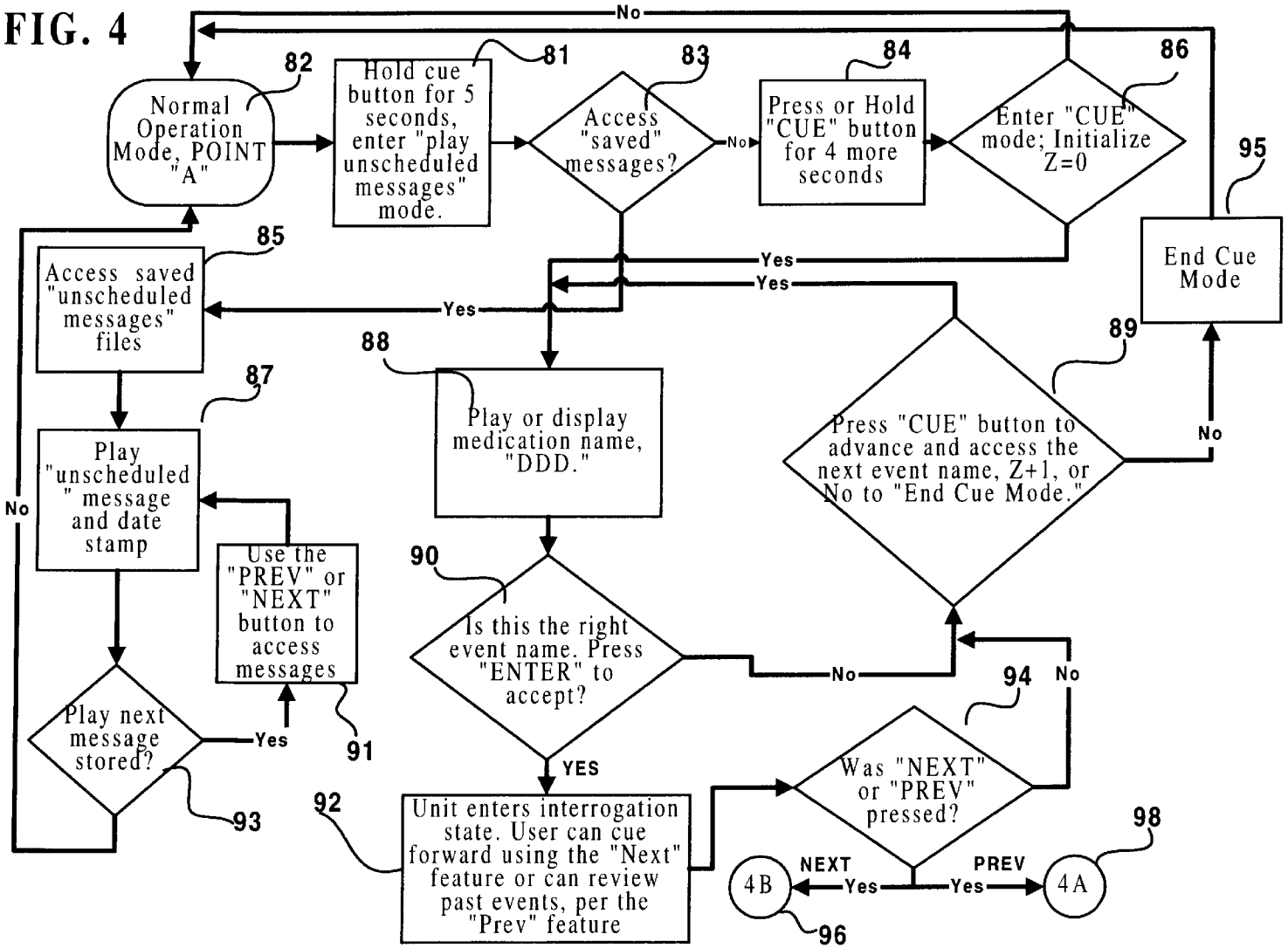
FIGS. 4, and 4A are detailed flow charts of the method used for cueing the device for review of historical events and previewing future events.
Figure 4A:
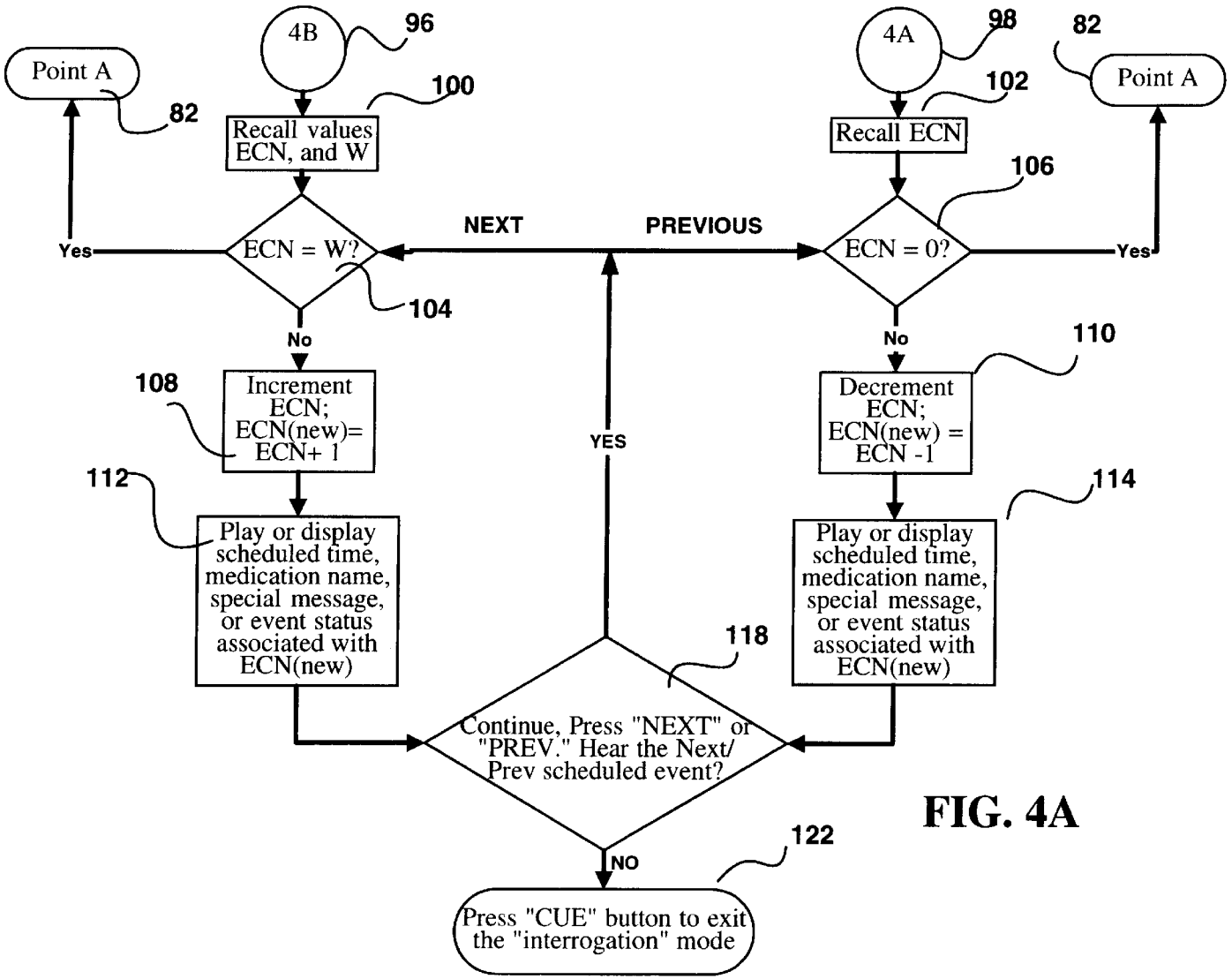

In one embodiment of this invention, pressing the cue button 28' for a predetermined amount of time accesses the patient initiated audio messages, see FIG. 4 and FIG. 4A. The doctor or care provider or patient can scroll through the messages in memory by using the PREV 30' and NEXT 32' keys. It should be noted that the prerecorded messages stored by the clinician or researcher are accessed by depressing the cue button 28' for a predetermined amount of time longer than what was necessary to access the patient initiated messages.

All audio messages, both prerecorded and unscheduled, are stored in a second memory device 47. This memory device can be Dallas Semiconductor Inc. EEPROM, or any other suitable memory device.

Figure 3:
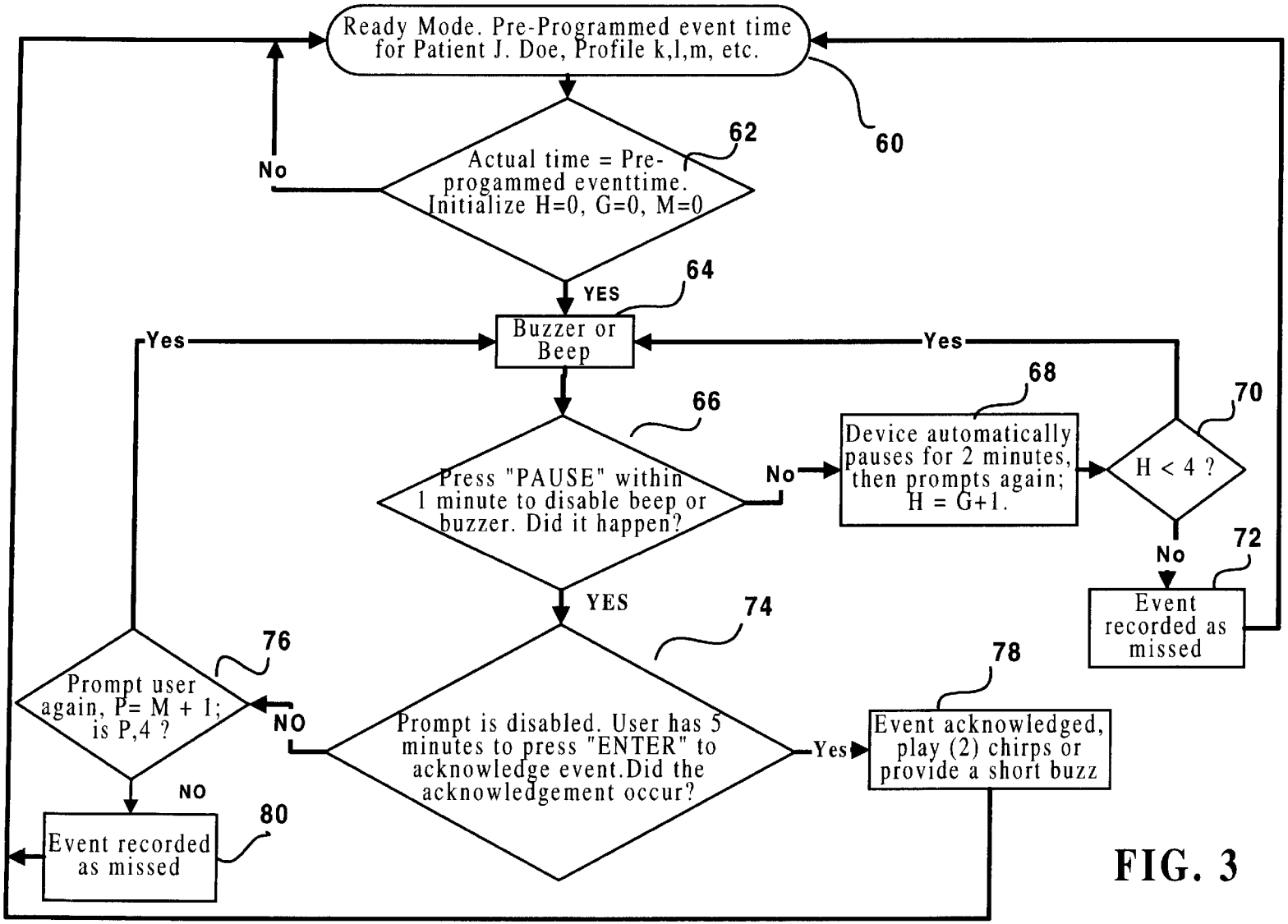
FIG. 3 is a detailed flow chart of the method for acknowledging the occurrence.

In particular, a flow chart of the preferred embodiment of this process is illustrated in FIG. 3. The device 20 is in "Ready Mode" 60 with the microcontroller 42 periodically polling the memory device 46. As shown in box 62, if the system time is equal to a pre-programmed event time, the microcontroller 42 initializes the state variables H, G and M and proceeds to alert the user as shown in box 64. Unless the user presses the pause button 26,26' within one minute, the microcontroller will proceed to box 68. At box 68, device automatically pauses the process for two minutes, increments the variable by one, and returns to box 64 where upon it prompts the user again. The user may be prompted up to three times, if the enter button 25, 25' is not pressed during this period (H<4), the event is recorded as missed as shown in box 72. At this point, the microcontroller 42 will store the event "missed" data in the memory device 46.

If during the "prompt", the user presses the pause button, box 66, the microcontroller proceeds to a timing loop 74 waiting for the user to acknowledge that the event is completed. During this "pause" period, the screen 24 will display the word "Paused". The purpose for the delay is to allow the user time to perform the required actions before acknowledging that the event has been completed. This also reduces the chance that the user will simply acknowledge the event without actually performing the instructions. This timing loop 74 can last up to five minutes or any other time designated. The loop will terminate by either having the user press the "Enter" button 25,25' or having the five minute limit reached. If the user does not acknowledge the event, the microcontroller 42 loops to box 76 where the variable P is incremented by one and the microcontroller 42 alerts the user again via box 64. As before, if the user fails to acknowledge the event, the microcontroller 42 in box 80 stores event missed data in the memory device 46 and loops back to "Ready Mode" box 60.

If the user does acknowledge the event via box 74, the microcontroller activate the beeper 44 in box 78 and plays two "chirps" or beeps. Having acknowledged the event, the microcontroller loops back to "Ready Mode" box 60. The acknowledged event is stored in memory device 46.

Figure 9:
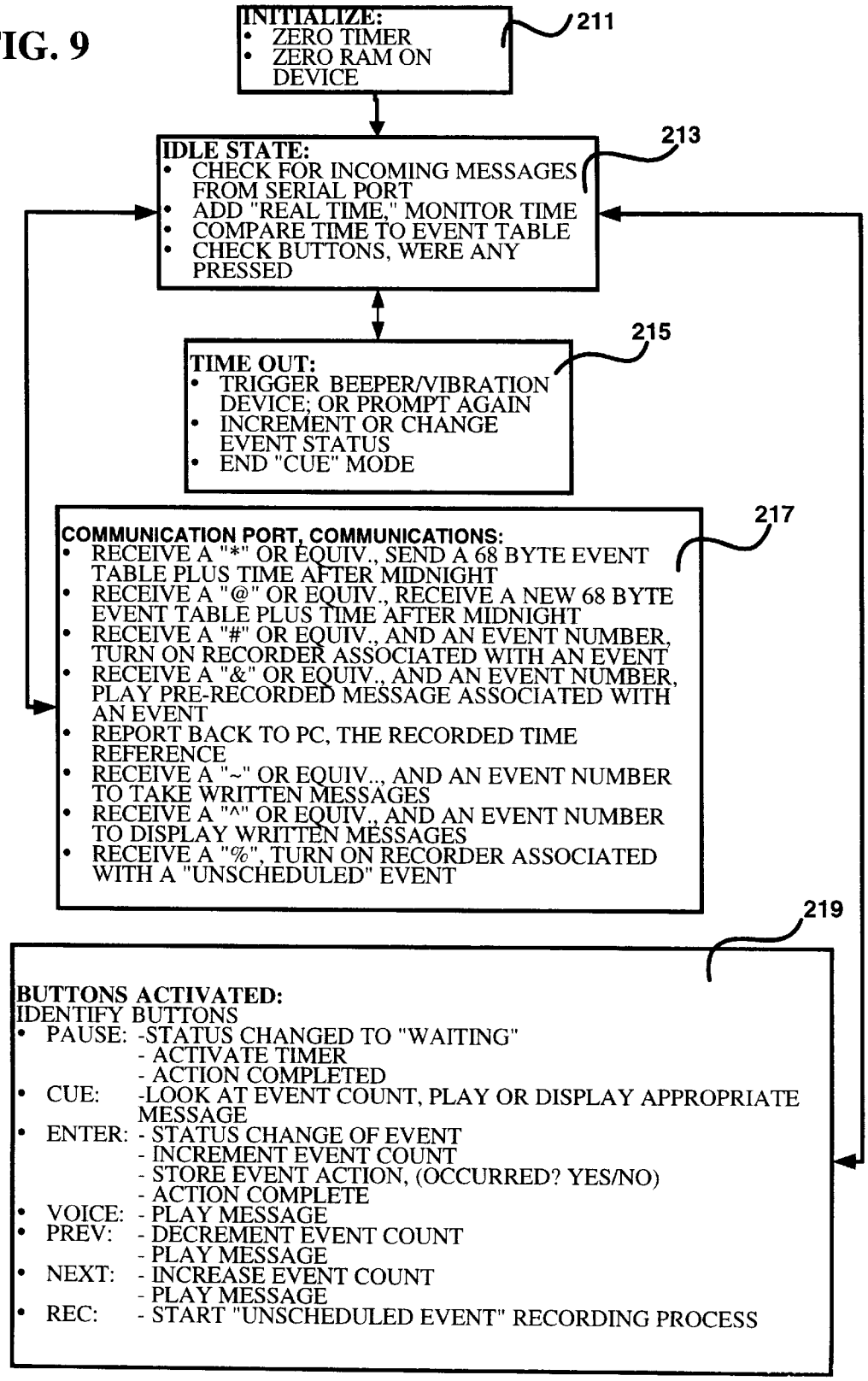
FIG. 9 is a block diagram state table for the microcontroller in the present invention.

In operation, the microcontroller 42 can have several different "state" depending on the particular sequence of events that has or is taking place. These states are best seen in the state table shown in FIG. 9, a possible embodiment of said invention. The first "state" is that of initialization state 211. The timer 43 is set to zero and the electronic RAM is also set to zero. This state is followed by the "Idle" state 213. This is the typical operation state of the microcontroller 42. While in this state 213, the microcontroller has several tasks. First it checks for an incoming signal from the communication port 23. If a signal is detected, the microcontroller 42 enters a "communications" state 217. After checking the communication port 23, the microcontroller 42 performs time functions and then compares the system time against a table of events stored in memory device 46. If there is a scheduled event, the device performs as described above. After comparing the event table, the microcontroller enters a "interface" state 219 which checks to see if any buttons 25,26,28,30,31,32, 200, 202 were pressed. The final state 215 is entered when the device needs to interact with the user, clinician, or researcher.

Referring now to FIG. 4, the device 20 also allows the user the functionality to review upcoming events in the display 45,24. From start block 82, the microcontroller responds to the Cue button 28,28' being activated in block 81. The activation block 81 is connected with decision block 83. If the user decides to access the unscheduled messages the Cue button 28,28' is depressed for 5 seconds, decision block 83 connects with block 85. Block 85 accesses the messages and proceeds to block 87 which plays the first unscheduled message. After playing the message, block 87 proceeds to decision block 93. If the user chooses to continue listening to messages, decision block 93 proceeds to block 91 which will play either the next message in memory, or the previous message in memory in response to the user pressing the NEXT or PREV button respectively. If the user does not desire to listen to any more messages, decision block 93 returns to start block 82.

If the user does not desire to listen to the unscheduled messages, decision block 83 connects with activation block 84. The activation block 84 is connected with decision block 86, if the Cue button 28,28' is held for 4 more seconds, the YES output proceeds to display block 88. Display block 88 causes the display device 24, 45 to display or device 52 to play the first medication name associated with the first profile stored in the memory device 46. The display block 88 is connected to decision block 90. The NO output of decision block 90 connects with decision block 89 where a "YES" choice retrieves the next event name from memory device 46 or a "NO" choice ends the "cue" mode in block 95 which connects back to Box 82. This loop continues until the user finds the medication of interest. Once the proper medication is found, decision block 90 proceeds from its YES output to interrogation block 92. The user may now review future or past events related to this medication. Note if there are any prerecorded audio messages associated with the events, the audio message will be replayed. Block 92 proceeds to decision block 94. In response to the Next button 32,32' being pushed, the "NEXT" loop is started and block 94 proceeds to block 96. Block 96 proceeds to block 100 shown in FIG. 4A. Block 100 pulls the variables ECN and W from the memory device 46. Variable ECN represents the current active Event Count for the chosen medication. Variable W represents the total number of scheduled events for the chosen medication. Block 100 proceeds to decision block 104. If the variable ECN equals W, then user has viewed all the events and returns to start block 82 via the YES output of decision block 104. The NO output of decision block 104 connects with block 108 which increments variable ECN. Block 108 connects with presentation block 112. Presentation block 112 retrieves event data associated wit variable ECN(new) from memory device 46 and displays the information in display device 24, 45 or plays the information from device 52. Block 112 proceeds to loop block 118. Loop block 118 waits for a response from the user. If there is no response by the user within 10 seconds, Block 118 defaults to Block 122 and exits the "cue" mode. If the user presses the Next button 32,32', loop block 118 connects to decision block 104. If during decision block 118, the user presses the Cue button 28,28',202, block 118 proceeds to block 122. Block 122 exits this subroutine.

If in decision block 94, the user pressed Prev button 30,30', the PREV output connects with bock 98. Block 98 connects to Block 102 as shown in FIG. 4A. The "PREV" process is similar to the NEXT loop described above. Block 102 pulls from memory device 46 variable ECN and connects with decision block 106. ECN represents the current Event Count. If ECN equal zero, decision block 106 proceeds through its YES output back to start block 82. There are no previous events.

The NO output of decision block 106 proceeds to block 110. Block 110 decrements variable ECN by one. Block 110 connects with presentation block 114 which pulls the data associated with the event data associated with variable ECN (new) from the memory device 46 and displays the information in display device 45 or plays the information from device 52. Presentation block 114 connects with loop block 118. If there is no response by the user within 10 seconds, Block 118 defaults to Block 122 and exists the "cue" mode If the user presses the Prev button 30,30' during loop block 118, the block 118 proceeds to decision block 106. If during decision block 118, the user presses the Cue button 28,28', block 118 proceeds to block 122. Block 112 exits this subroutine.

In addition to the device 20, the invention requires a programming device for creating the data set stored in memory device 46. As shown in FIG. 2, the preferred embodiment uses a host computer 58, such as an INTEL PENTIUM based, IBM compatible personal computer having 16 megabits or greater, of random access memory (RAM). A storage device such as a hard drive, input/output devices such as a keyboard and monitor, and a communications port. All of these devices are operatively connected to the host computer's main processor.

In an alternate embodiment, the host computer would be a hand held portable device. It is conceivable that such a device could be carried by an ambulance emergency medical technician responding to a call. The portable host could be used by the technician to determine what pharmaceuticals the victim has taken to avoid a potentially harmful drug interaction. Such a portable host device could also be used by a visiting nurse to check on patents during a visit. Such a system could make use of the serialization feature of the memory device 46. If the portable host was preprogrammed with the patient profile, it could compare the historical data from the device against the profile data and automatically generate a report detailing which events have occurred and/or events which have been missed.

Figure 5:
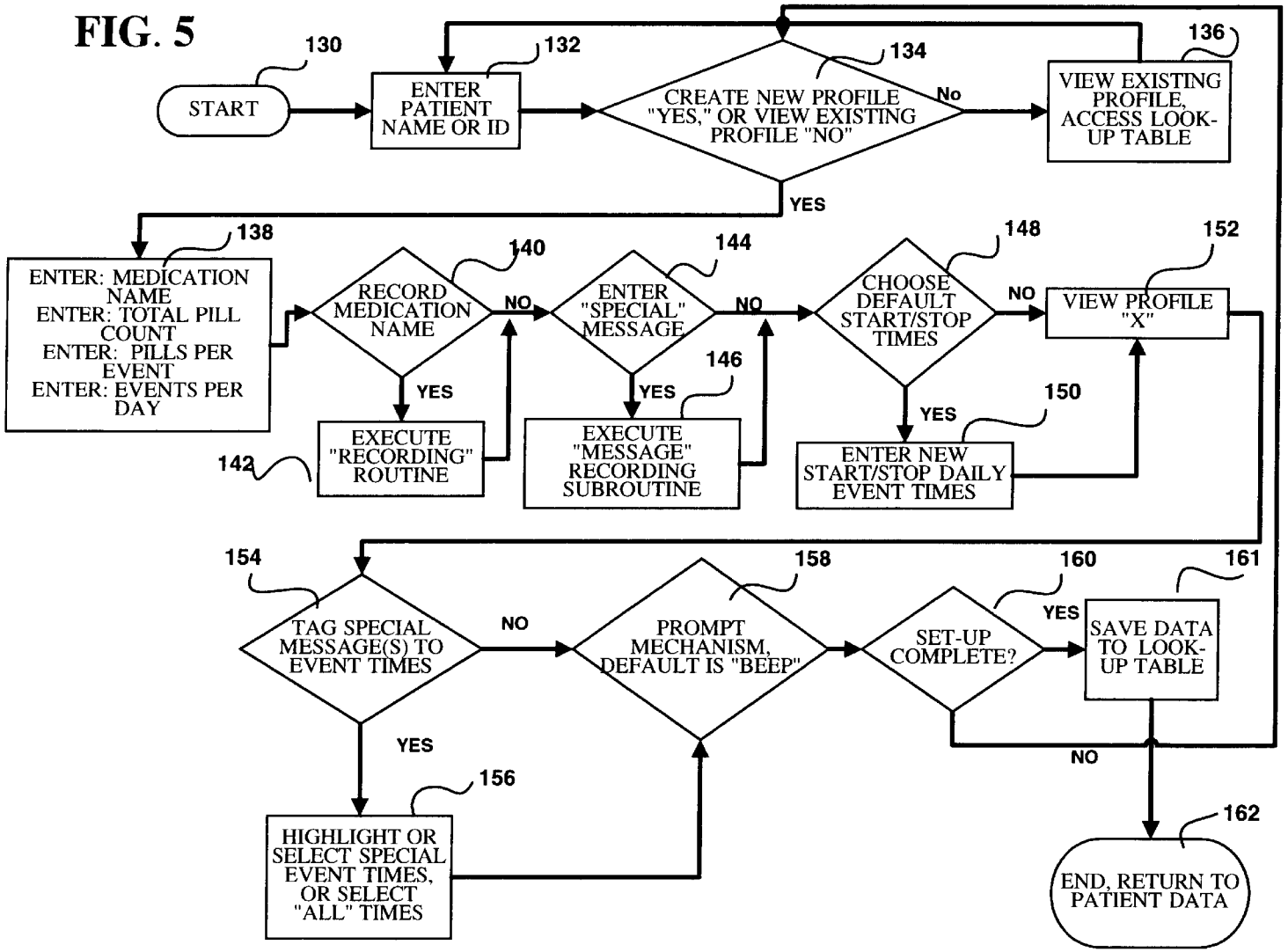
FIG. 5 is a detailed flow chart of the patient profile and event set-up routine.

In one embodiment, a software program running in the host computer used to generate the event data set and then transmit through the communications port to line 56 to the data box 54 as is shown in FIG. 2. FIG. 5 shows a flow chart illustrating how the software operates to create the data set.

Start block 130 connects with input block 132 that prompts the researcher, doctor or pharmacist for the users name or identification number. The researcher, doctor or pharmacist can also be referred to as the programmer. Block 132 connects with decision block 134 that asks the programmer whether they would like to create a new profile. In this context, a profile represents all the data for a given event. The NO output connects with block 136 that finds the existing data in a previously created lookup table and connects back to block 132.

The YES output of decision block 134 connects to prompt block 138. Block 138 asks the programmer to enter: 1) medication name or acceptable abbreviation, 2) the total pill count, 3) the amount of the medication to be taken at each event, and 4) the number of events per day. Block 138 connects to decision block 140 which queries for the spoken medication name. The YES output connects with record block 142 that executes the recording subroutine. Block 142 and the NO output from decision block 140 connect to decision block 144 which queries whether a special message is required. The YES output of block 144 connects to block 146 the message recording subroutine. Block 146 and the NO output of block 144 connect with decision block 148. Decision block 148 asks the programmer if they would like to enter daily event start/stop times. The YES output connects with prompt block 150 that prompts the programmer to enter the daily start and stop times. These times represent when the event prompting period begins and ends. A prompting period is length of the time that the programmer would like the device to operate. This is done to prevent the user from being prompted during typical sleeping hours unless the programmer requires it. The medication events are then equally spaced been the start and stop times. This allows the programmer to adjust the medication schedule to fit the user's normal schedule.

Block 150 and the NO output from decision block 148 connect with display block 152 which displays on the host computers monitor the profile that was just created. Block 152 proceeds to decision block 154 which asks the programmer if they want to associate the special message recorded in block 146 with a particular event time or all event times. The YES output from block 154 connects with block 156 that prompts the user to enter the event time(s). Block 156 and the NO output of block 154 connect with block 158. Block 158 asks the user to enter which of the components in device 20 they would like to use to alert the user that an event has occurred. By default, the beeper 44 is activated. Block 158 connects with block 160 completing the profile set-up. Block 160 connects with save block 161 that saves the profile to the look-up table. Block 161 connects with end block 162 that exits the routine.

Figure 6:
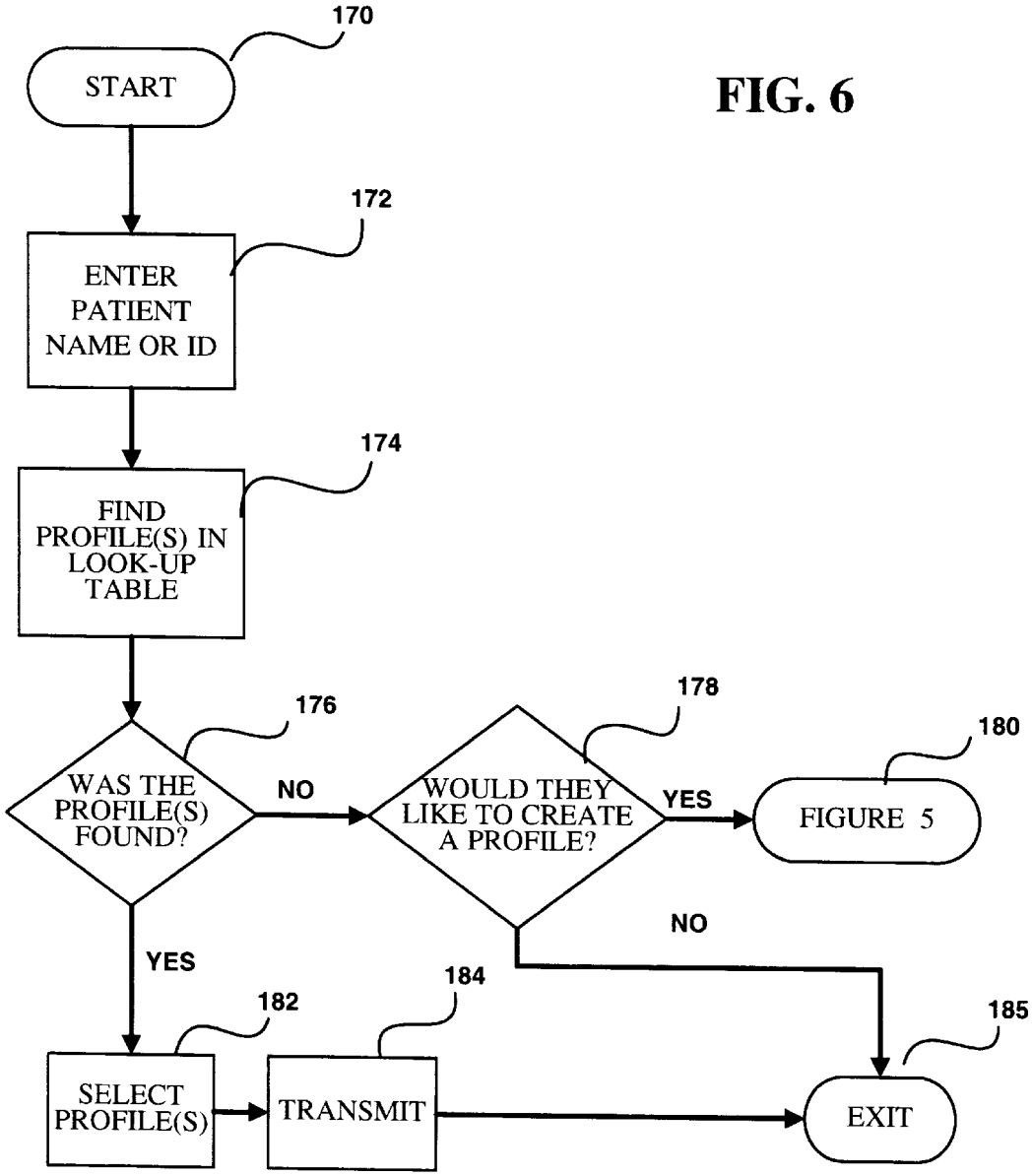
FIG. 6 is a detailed flow chart of the method used for transmitting data from the host computer to the device of this invention.

The last step in programming the device 20 is to transmit the data set from the host computer 58 to the device 20. FIG. 6 shows the process by which the correct data set is transmitted. Start block 170 connects with prompt block 172. Block 172 asks the programmer to enter or select either the user name or identification number. Block 172 connects with block 174 that looks the user's name or identification number up in a look-up table and then connects with decision block 176. If no profile is found for the user, the chart proceeds through NO output and connects with block 178 that asks the user if they would like to create a new profile. If they do, the YES output connects with block 180 which is also the start block 130 of FIG. 5. If they do not want to create a new profile the routine exits.

The YES output of decision block 176 connects with block 182. Block 182 prompts the programmer to select the profiles they want to transmit to the device 20. Block 182 connects with Block 184 that transmits the selected profile data sets and transmits them from the host computer through the communications port to line 56.

In an alternate embodiment, a bar-code reader via communications line 41 programs the device 20. The microcontroller 42 receives the bar-code data, translates it into event data and stores this data in memory device 46. The physician or pharmacist could then scan the bar code to program the device after checking for contraindications. Alteratively, the pharmacist could place the bar code on the prescription bottle and allow the user to program the device himself.

Figure 7A:
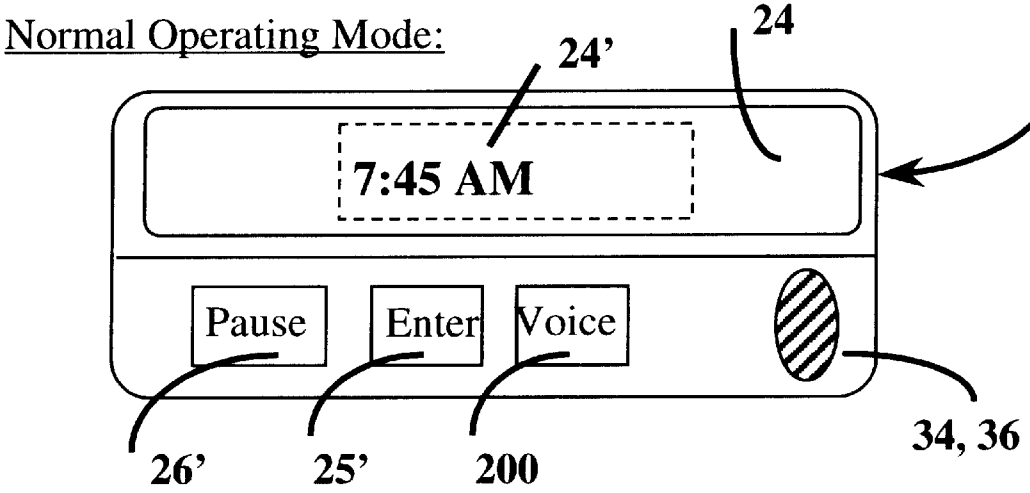
FIG. 7A is a front view of an alternate embodiment of this invention while operating in Normal Mode.
Figure 7B:
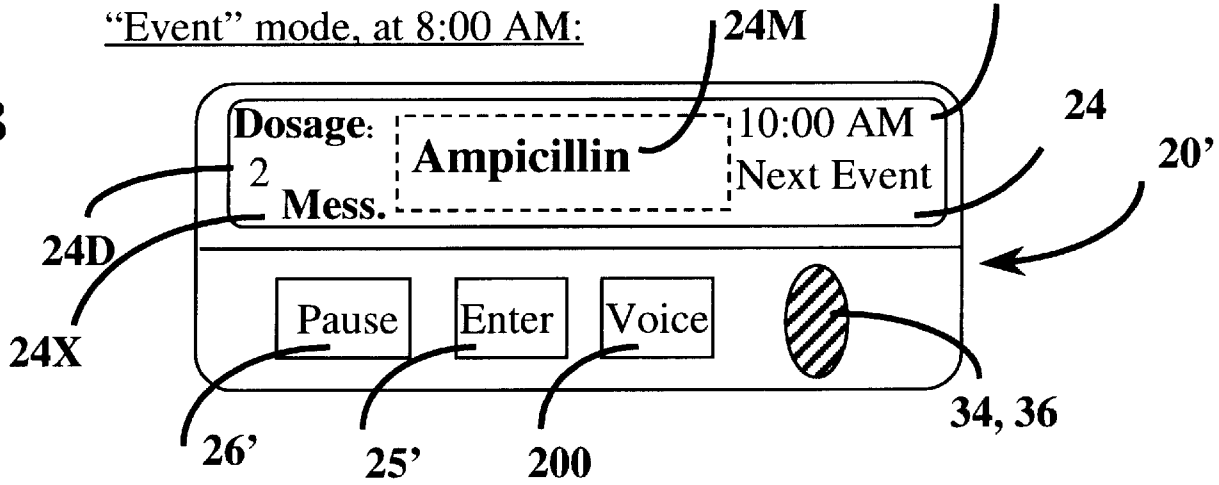
FIG. 7B is a front view of an alternate embodiment of this invention while operating in Event Mode.
Figure 7C:
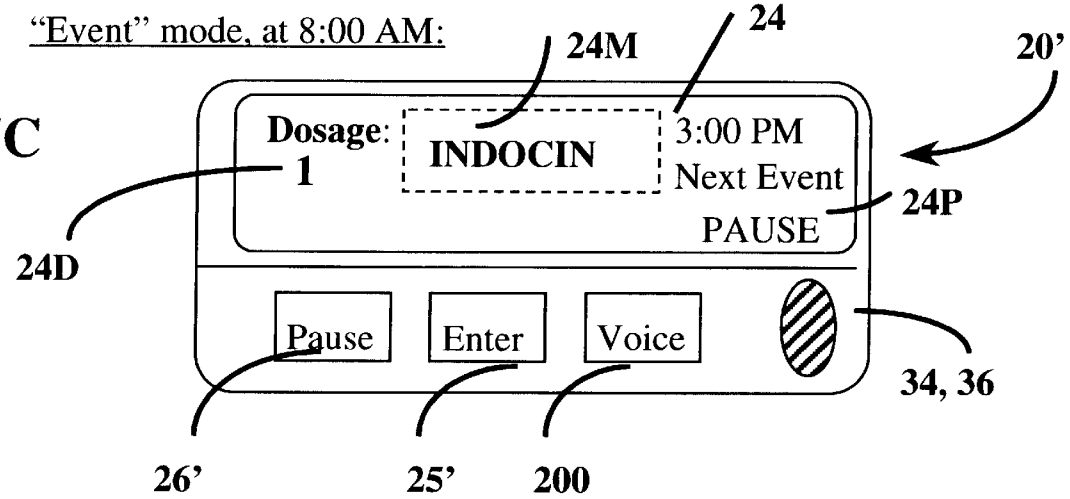
FIG. 7C is an alternate front view of an alternate embodiment of this invention while operating in Event Mode.
Figure 7D:
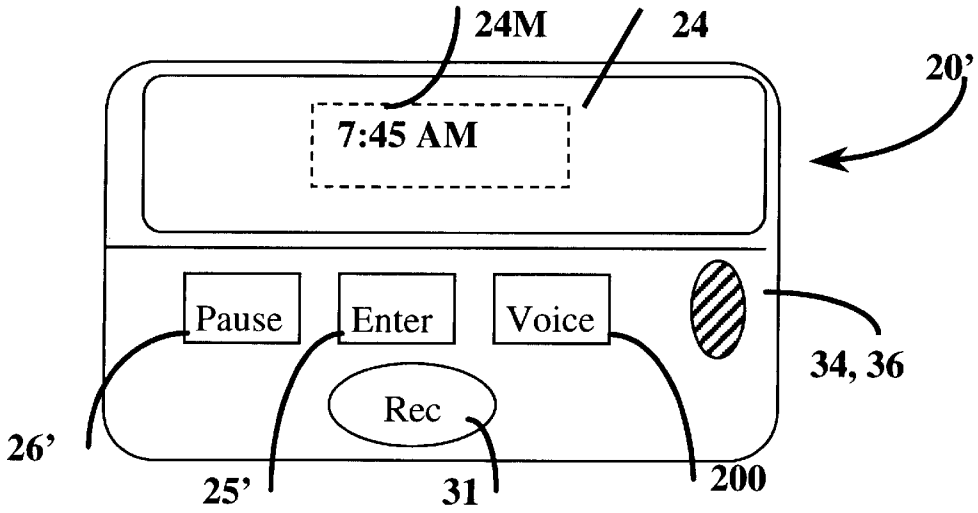
FIG. 7D is an alternate front view of an alternate embodiment of this invention having recording functionality.

FIGS. 7A–7C show alternate embodiments of the present invention expected for use in the clinical and home health care areas. These views show the device 20' in various operating modes. As can be seen, this embodiment only uses three buttons; a "Pause" button 26', an "Enter" button 25', and a "Voice" button 200. FIG. 7A shows the device operating in "normal" mode. The display 24 shows the present time 24'. FIG. 7B shows the device in its "Event" mode of operation. The display 24 is broken up into a number of different areas; the medication name 24M to be taken, the time of the next event 24T, the dosage number 24D and a message prompt 24X. The message prompt 24X is displayed to indicate to the user that there is a audio message associated with this event. To hear the message the user pushes the voice button 200. If the user pushes the voice button 200 and no message was associated with the event, the device will play the event or prescription name. The number displayed in the dosage area 24D indicates to the user that if the event is dosage specific, what quantity should be taken. Alternatively, this number may represent the elapsed event count. FIG. 7C is similar to FIG. 7B except that an additional display area is shown. This area 24P displays a "Paused" message indicating that the user has pushed the pause button.

Figure 8A:
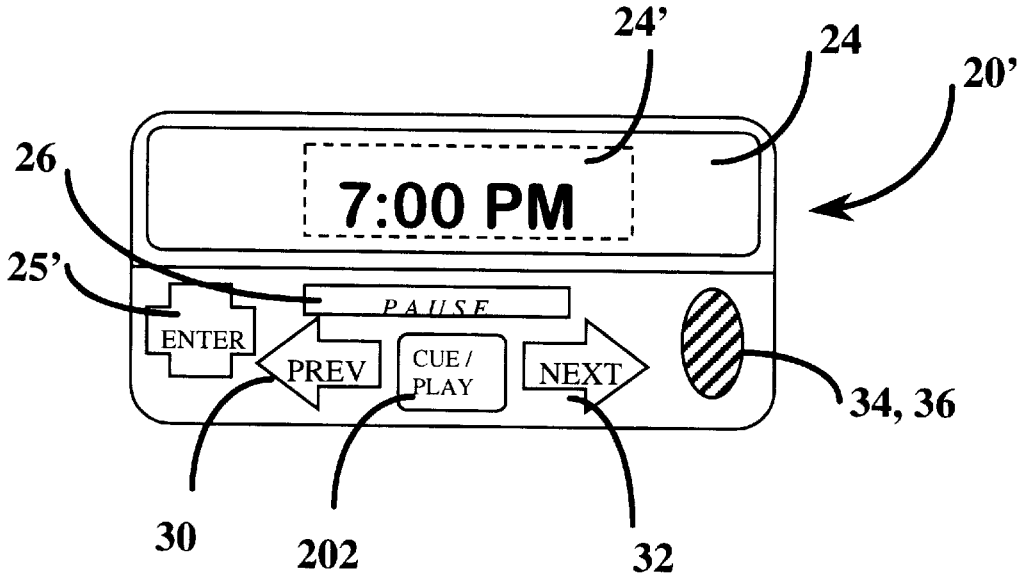
FIG. 8A is a front view of an alternate embodiment of this invention while operating in Normal Mode.
Figure 8B:
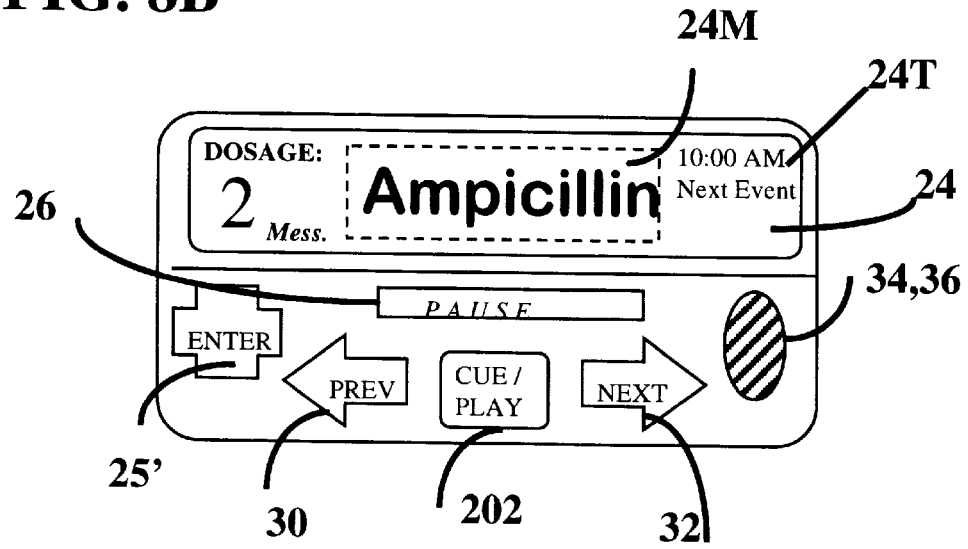
FIG. 8B is a front view of an alternate embodiment of this invention while operating in Event Mode.
Figure 8C:
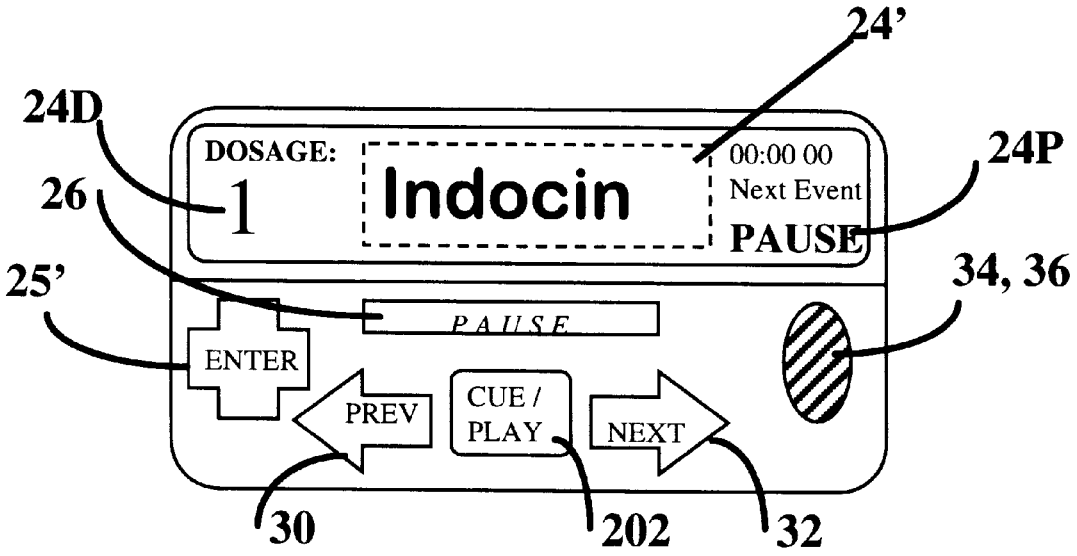
FIG. 8C is a front view of an alternate embodiment of this invention while operating in Event Mode.

FIGS. 8A–8C show an alternate embodiment of the present invention which may be used in areas such as pharmaceutical research. Similar to the clinical embodiment shown in FIGS. 7A–7C, the display 24 is broken up into different areas. The difference with this embodiment is that the "Prev" 30 and "Next" 32 buttons are used to allow the user to view future and historical events. The operation of these features is the same as previously described. An additional button 202 is pressed by the user when they need to hear any audio messages associated with the present event.

As described above, in the preferred embodiment, a host computer 58 runs software 210 used to program the device 20. The purpose of the host software 210 is to create data sets, store the data in an appropriate database, transmit event tables and retrieve event tables. Refer now to FIGS. 10–13 which shows examples of user interface screens 212, 240, 252, and 260. These screens are used by the host program 210 to help the clinician, researcher or pharmacist prepare and transfer data, or retrieve and view data.

Figure 10:
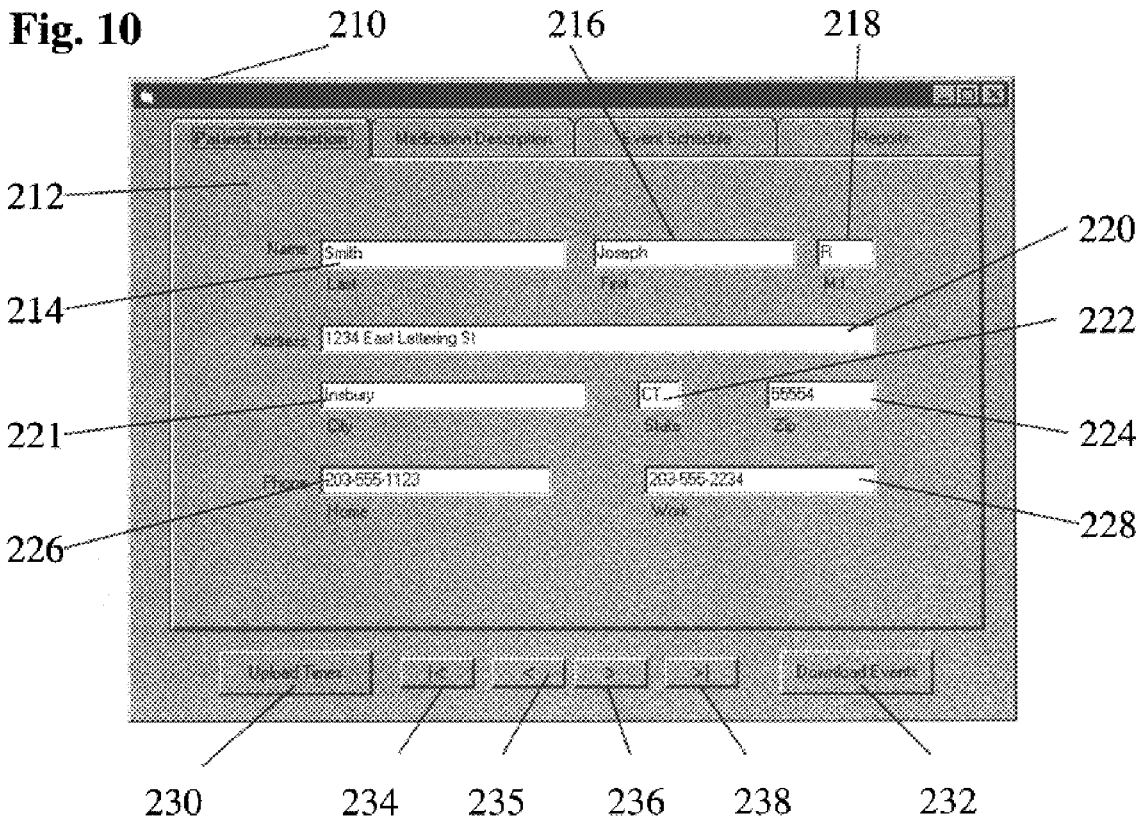
FIG. 10 is the user information screen for the software used on the host computer in the present invention.

The user information screen 212 allows the programmer to input various data about the user. As shown in FIG. 10, user information screen 212 contains a number of data fields, including; user last name 214, user first name 216, user middle initial 218, user street address 220, user address city 221, user address state 222, user address zip code 224, user home phone number 226, and user work phone number 228. In addition, there is a set of buttons 234, 235, 236,238 which are common to all the screens 212, 240, 252, 260 of the host program 210. These buttons are responsive to operator actions, such as selecting and clicking on the button with a mouse or other similar input device.

Four navigation buttons 234, 235, 236, 238 are provided to allow the operator to change between records. Button 234 labeled "|<" changes the screen to the first record in the host program's 210 database. Button 235 labeled "<" changes the data displayed on the current screen to the previous record in the host program's 210 database. Button 236 labeled ">" changes the data displayed on the current screen to the next record in the host program's 210 database. Button 238 labeled ">|" changes the data displayed on the current screen to the last record in the host program's database.

Figure 11:
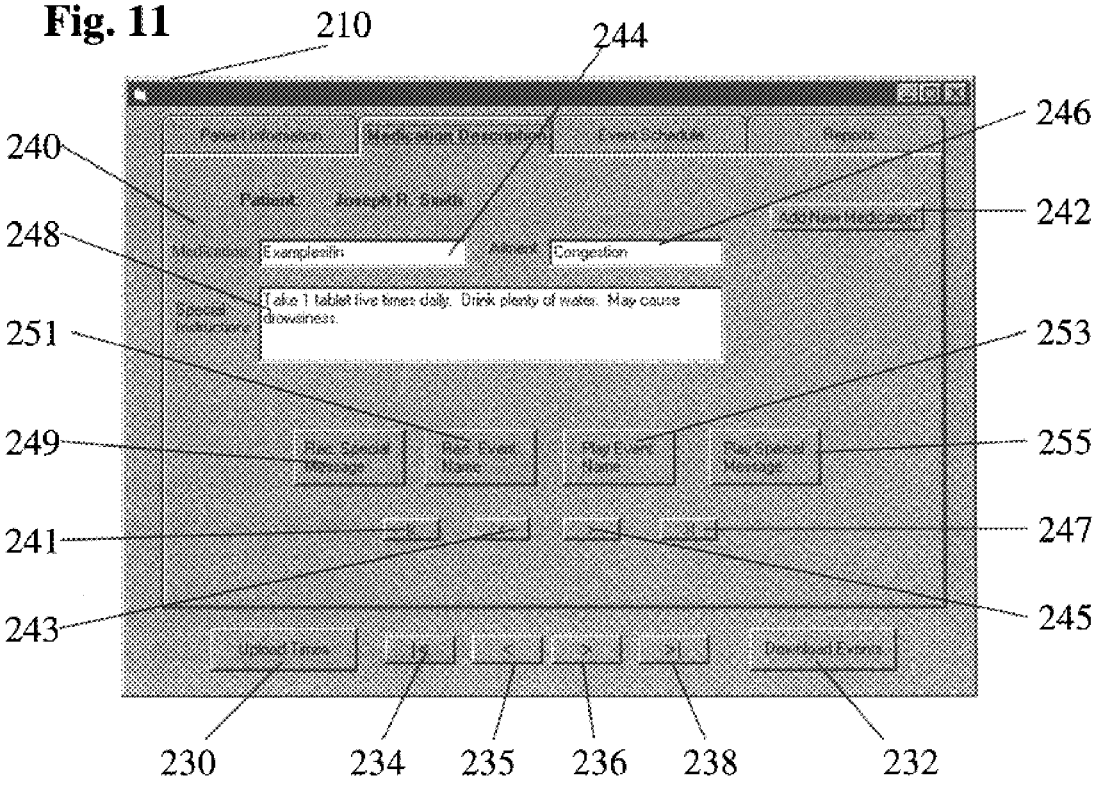
FIG. 11 is the medication description screen for the software used on the host computer in the present invention.

The medication descriptions screen 240 is seen in FIG. 11. This screen has three data fields; medicine name 244, ailment 246 and special instructions 248. There are four additional navigation buttons 241, 243, 245, 247 to allow the programmer to change to another medication taken by the user displayed. This screen is also used to create audio recordings. Buttons 249 and 251 are used to record special messages and record event names respectively. "Play Event Name" button 253 and "Play Special Message" button 255 are used by the programmer to listen to messages they have already recorded. The Final button of the screen is "Add New Medication" button 242. This function is used by the programmer to add a new medication to the users profile.

In an alternate embodiment, the Add New Medication button 242 will be linked to a commercially available database of pharmaceuticals allowing the programmer to chose the medication. The host program could then pull any information necessary for the patient profile directly from the database. This step would save the programmer time and reduce the potential for error.

Figure 12:
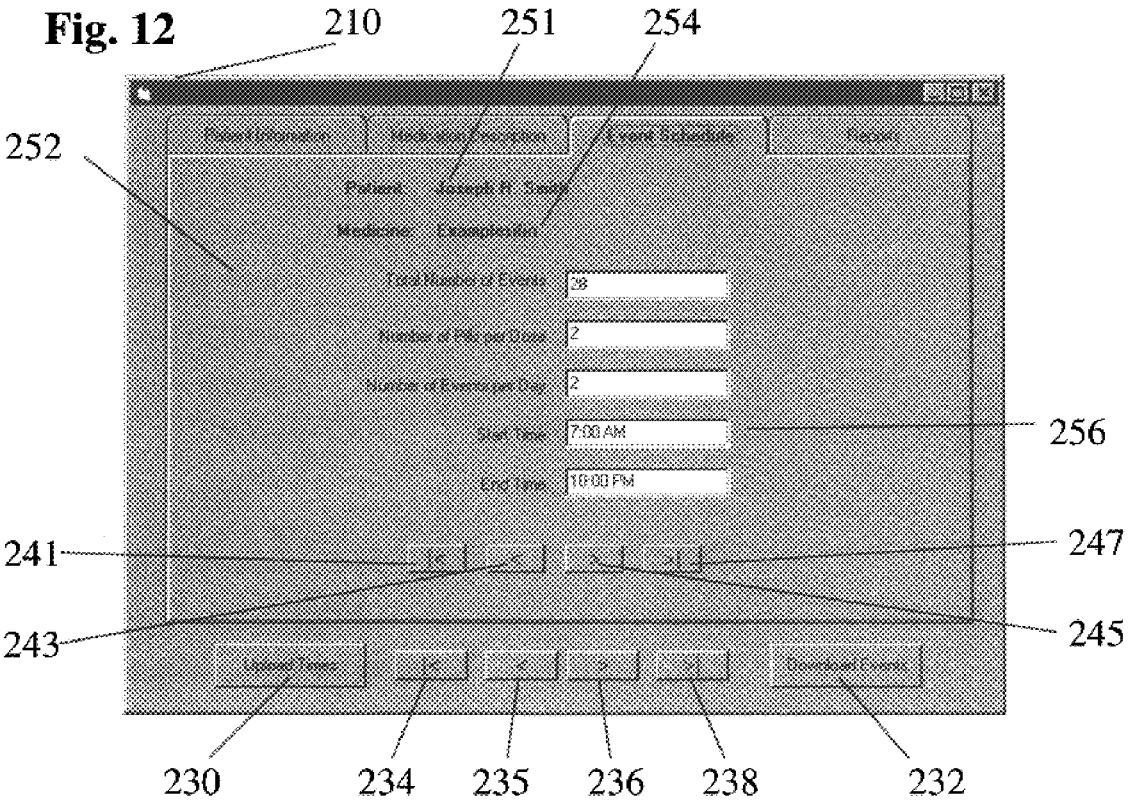
FIG. 12 is the dosage timetable screen for the software used on the host computer in the present invention.

The dosage timetable screen 252 is shown in FIG. 12. The user name 251-and current medication 254 are displayed. The operator may then input the times that the displayed medication should be taken. Four navigation buttons 241, 243, 245, 247 are used to move between the various medicine records that are associated with the displayed user.

Figure 13:
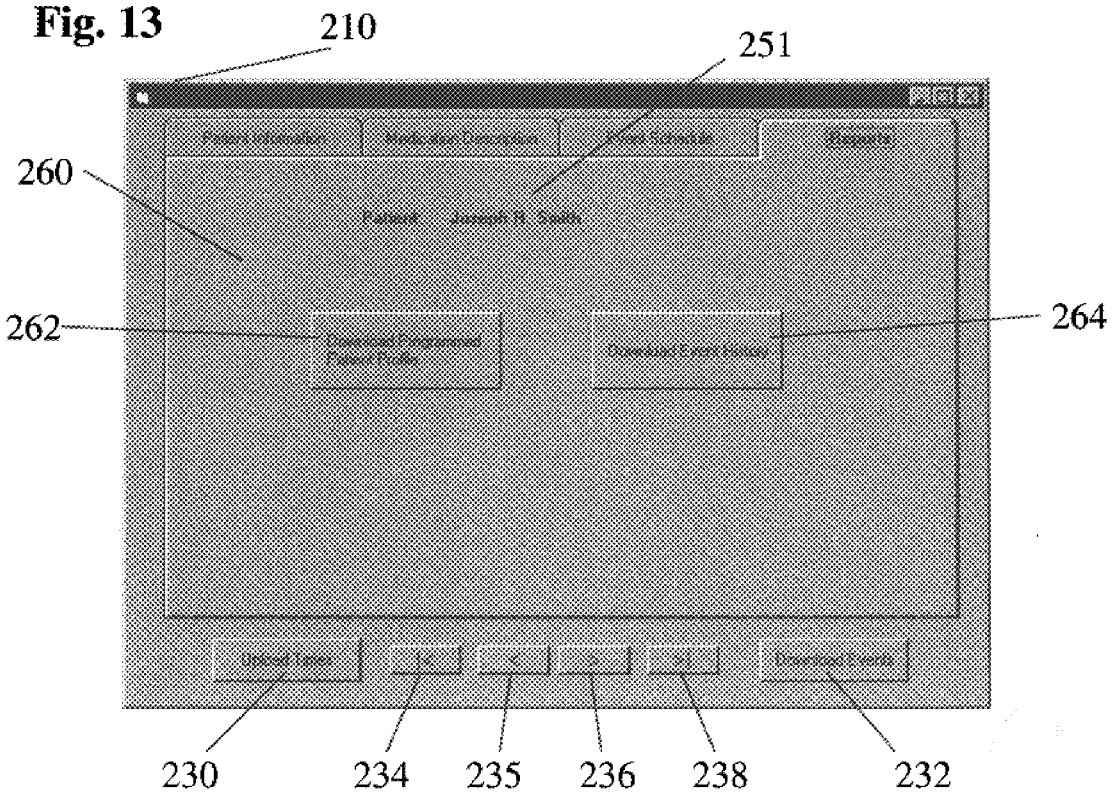
FIG. 13 is the report screen for the software used on the host computer in the present invention.

The final screen, the reports screen 260, as shown in FIG. 13 allows the clinician or researcher to access and view the data downloaded from the device 20. This screen contains a user name field 251 indicating which patient's profile data will be uploaded or downloaded. Buttons 262 and 264 are provided to allow the programmer to select which particular parts of the data are to be uploaded or downloaded.

The upload times button 230 refers to data being loaded from the device 20 to the host computer 58. When upload times button 230 is selected, the host program 210 sends a "*" character through communication line 56 and data transmission box 54 to the device 20. In response, upon receiving the signal, the microcontroller 42 transmits the event table and the system "time after midnight" back through data transmission box 54 and communication line 56 to the host computer 58. The data is received by the host program 210 and can be accessed from the reports screen 260.

The download button 232 refers to data being transferred from the host computer 58 to the device 20. When the "download events" button 232 is selected, the host program 210 sends a "@" character through communication line 56 and data transmission box 54 to the device 20. In response, upon receiving the signal, the microcontroller 42 receives the event table and time after midnight and stores in memory device 46. Once the data has been downloaded, the programmer will have the option to save the data to a storage device such as a hard drive on host computer 58.

As is typical in these types of data transmission systems, when data is received from an external source (be it either the host program 210 or the device 20), the data will be verified using a standard data error check, such as CRC (Cyclic Redundancy Check).

Although the present invention has been described with reference to certain embodiments, it will be appreciated that these embodiments are not limitations and that the scope of the invention is defined by the following claims.

We claim:

1. A patient event monitoring method comprising the steps of:

a) programming into a portable device memory a patient profile, said profile including at least one profile time and at least one event and pause time associated with said at least one profile time;

b) periodically comparing said at least one profile time against an actual system time;

c) alerting the user when said profile time matches said system time;

d) enabling the execution of a pause function on said portable device;

e) executing a pause function on said portable device in response to a patient command;

f) waiting said pause time once said pause function has been executed;

g) enabling the execution of an acknowledgment function on said portable device;

h) storing event completed data in said memory if said acknowledgment function was executed within said pause time, said event completed data including information on whether or not said event was confirmed within said pause time.

2. The method of claim 1 including the following step:

i) repeating steps c)–h) a second time if said user alerting was not acknowledged after step g).

3. The method of claim 2 including the following step:

j) repeating steps c)–h) a third time if said patient alerting was not acknowledged after step g).

4. The method of claim 3 including the step of displaying said event data associated with said profile time that matches said system time between steps c) and d).

5. The method of claim 4 including the step of downloading said data stored in said electronic memory to an external host.

6. The method of claim 1 including the step of downloading said data stored in said memory to a host computer.

7. The method of claim 1 including the step of recording a verbal message and storing said message in said memory.

8. The method of claim 7 including the step of downloading said data stored in said electronic memory to a host computer.

9. The method of claim 7 including the step of retrieving said verbal message from said electronic memory and replaying said message.

10. The method of claim 9 wherein said replaying step is accomplished using an audio speaker.

11. The method of claim 3 wherein said predetermined amount of time is less than five minutes to pause a prompting feature.

12. The method of claim 3 wherein said predetermined amount of time is less than two minutes to pause a prompting feature.

13. The method of claim 3 wherein said patient profile data further includes a plurality of said predetermined times, each of said plurality of predetermined times associated with an event such that each event can have a different predetermined amount of time.

14. A system for monitoring patient compliance to medical events, the system comprising:

a host computer having:

a microprocessor;

a data entry device operably coupled to said microprocessor, said data entry device capable of entering patient profile data, said data including at least one event time, and an event data and pause time associated with said event time, said event data including visual and audible descriptions of the event;

a monitor operably coupled to said microprocessor, said monitor capable of displaying patient data;

a communications device operably coupled to said microprocessor, said communications device including a receiver and a transmitter capable of receiving and sending said profile data;

a storage device operably coupled to said microprocessor, said storage device storing said profile data for retrieval at a later time;

a portable device, said device having:

a microcontroller, said microcontroller including internal time circuitry for maintaining a system time;

a comparator operably coupled to said microcontroller, said comparator capable of comparing a profile time to said system time;

a communications device removably coupled to said host computer, said communications device being able to receive and transmit data from and to said host;

a memory operably coupled to said microcontroller;

a storage device operably coupled to said microcontroller, said storage device storing said profile data;

a prompting device operable coupled to said microcontroller and being responsive to said comparator for generating an audible and visual signal when said system time matches one of said event times, said visual signal being the event description corresponding to the event time that matches said system time;

a pausing input device operably coupled to said microcontroller, said pausing input device being responsive to the user for silencing said prompting signal for a predetermined amount of pause time;

an acknowledgment input device operably coupled to said microcontroller, said acknowledgement input device being responsive to the user for confirming said event has occurred;

said comparator further determines if said event was confirmed within said predetermined amount of pause time, said comparator storing an event completed data in said memory, said event completed data including information on whether or not said event was confirmed within said predetermined amount of pause time.

15. The system of claim 14 wherein:

said comparator further determines if said event was confirmed occurred after said predetermined amount of pause time, and controls said prompting device for generating a second signal after said predetermined amount of pause time expires.

16. The system of claim 15 wherein:

said comparator further determines if said event was confirmed after a second predetermined amount of pause time, said comparator storing an event completed data in said memory, said event completed data including information on whether or not said event was confirmed within said second predetermined amount of pause time.

17. The system of claim 16 wherein said communications device of said portable device is comprised of a data transmission box external to said portable device and a communications port internal to said portable device and operably connected to said microcontroller, said data transmission box being capable of receiving data from said host and transmitting it to said communications port.

18. A system for monitoring patient compliance to medical events, the system comprising:

a host computer including:

a microprocessor;

a data entry device operably coupled to said microprocessor, said data entry device capable of inputting patient profile data, said data including at least one event time and event data and pause time associated with said event time, said event data including visual and audible descriptions of the event;

a communications device coupled to said microprocessor, said communications device including a receiver and transmitter for receiving and sending profile data to an external device;

a storage device operably coupled to said microprocessor, said storage device capable of storing said profile data for retrieval at a later time;

a portable device, said device including:

a microcontroller, said microcontroller including internal time circuitry for maintaining a system time;

a communications device operably coupled to said microcontroller, said communications device transmits and receives data from said host;

a memory operably coupled to said microcontroller;

a storage device operably coupled to said microcontroller, said storage device storing said profile data;

a comparator operably coupled to said microcontroller, said comparator capable of comparing said profile time to said system time;

a prompting device coupled to said microcontroller and responsive to said comparator, said prompting device generates a audible and visual signal when said system time matches one of said event times, said visual signal being the event description corresponding to the event time that matches said system time;

a pausing input device operably coupled to said microcontroller, said pausing input device being responsive to the user for silencing said prompting signal for a predetermined amount of pause time;

an acknowledgment input device operably coupled to said microcontroller, said acknowledgement input device being responsive to the user for confirming said event has occurred;

a microphone, said microphone operably connected to said microcontroller.

19. The system of claim 18 further comprising:

a recorder operably coupled with said microcontroller, said recorder receives an audio signal from said microphone and stores said audio signal as audio data with the current system time in said memory means.

20. The system of claim 18 further comprising a speaker;

a player operably coupled to said microcontroller and said speaker, said player retrieves said audio data from said memory and replays the audio signal through said speaker.

21. A portable event monitoring device, said device comprising;

a microcontroller, said microcontroller including internal timing circuitry for maintaining a system time;

a comparator coupled to said microcontroller;

a memory operably coupled to said microcontroller;

a storage device operably coupled to said microcontroller, said storage device stores profile data, said profile data including at least one event time and event data and pause time associated with said event time;

a prompting device responsive to said comparator for generating an audible and visual signal when said system time matches an event time, said visual signal being the event description corresponding to the event time that matches said system time;

a microphone, said microphone operably connected to a said microcontroller;

a pausing input device coupled with said microcontroller, said pausing input device being responsive to the monitoring device user for silencing said prompting signal for a predetermined amount of pause time;

an acknowledgement input device coupled with said microcontroller, said acknowledgement input device being responsive to commands from the monitoring device user;

an event recorder coupled with said microcontroller, said event recorder storing in memory data indicating if said acknowledgement input device or said pausing input device was activated by the monitor device user.

22. The portable event monitoring device of claim 21 further comprising:

a recording device coupled with said microcontroller, said recording device receives an audio signal from said microphone.

23. The portable event monitoring device of claim 22 further comprising a speaker;

a player for retrieving said audio data and replaying the audio data through said speaker.

24. The portable event monitoring device of claim 23 further comprising:

a communications device having a transmitter and a receiver.

25. A portable event monitoring device, said device comprising;

a microcontroller, said microcontroller including internal timing circuitry for maintaining a system time;

a comparator operably coupled with said microcontroller;

a memory operably coupled to said microcontroller;

a storage device operably coupled to said microcontroller, said storage device storing profile data, said profile data including at least one event time;

a prompting device responsive to said comparator, said prompting device generating an audible and visual signal when said system time matches one of said event times, said visual signal being an event description corresponding to said event time that matches said system time;

a pausing input device coupled to said microcontroller, said pausing input silencing said prompting audible signal for a predetermined amount of pause time;

an acknowledgment input device for confirming said event has occurred;

said comparator further determines if said event was confirmed within said predetermined amount of pause time, said comparator storing an event completed data in said memory, said event completed data including information on whether or not said event was confirmed within said predetermined amount of pause time.

26. The portable event monitoring device of claim 25 wherein:

said comparator further determines if said event was confirmed after said predetermined amount of time, and controls said prompting device for generating a second signal after said predetermined amount of pause time expires.

27. The portable event monitoring device of claim 26 wherein:

said comparator further determines if said acknowledgment input occurred after a second predetermined amount of pause time, said comparator storing an event completed data in said memory, said event completed data including information on whether or not said event was confirmed within said second predetermined amount of pause time.

* * * * *